US005820805A

United States Patent [19]

Hodan

[11] Patent Number: 5,820,805

[45] Date of Patent: Oct. 13, 1998

[54] PROCESS FOR MAKING MULTICOMPONENT ANTISTATIC FIBERS

[75] Inventor: John A. Hodan, Arden, N.C.

[73] Assignee: BASF Corporation, Mt. Olive, N.J.

[21] Appl. No.: 893,028

[22] Filed: Jul. 15, 1997

Related U.S. Application Data

[62] Division of Ser. No. 761,696, Dec. 6, 1996.

[51] Int. Cl.[6] ..... B29C 47/00

[52] U.S. Cl. ..... 264/177.2; 264/171; 264/177.17; 427/180; 427/316; 427/343

[58] Field of Search ..... 427/180, 205, 427/316, 343; 428/372, 373, 394, 395, 389, 374, 397, 359; 264/171, 177, 177.2, 177.17

[56] References Cited

U.S. PATENT DOCUMENTS

| | | | |
|---|---|---|---|
| 3,803,453 | 4/1974 | Hull | 317/2 R |
| 3,823,035 | 7/1974 | Sanders et al. | 117/226 |
| 3,958,066 | 5/1976 | Imamura et al. | 428/372 |
| 4,045,949 | 9/1977 | Paton et al. . | |
| 4,129,677 | 12/1978 | Boe . | |
| 4,185,137 | 1/1980 | Kinkel . | |
| 4,207,376 | 6/1980 | Nasayasu et al. . | |
| 4,216,264 | 8/1980 | Naruse et al. . | |

*Primary Examiner*—Merrick Dixon

[57] ABSTRACT

Electrically conductive fiber is made from a multicomponent filament having a suffusible component present at some or all of the periphery of the filament, and an impervious component that is substantially impervious to a suffusion coating solution. Finely-divided, electrically conductive particles are suffused into a surface of the suffusible component to render an electrical resistance in the filament of not more than about $10^9$ ohms/cm but the particles do not significantly suffuse into the impervious component.

12 Claims, 1 Drawing Sheet

PROCESS FOR MAKING MULTICOMPONENT ANTISTATIC FIBERS

This is a divisional of copending application Ser. No. 08/761.696, filed on Dec. 6, 1996, now pending.

FIELD OF THE INVENTION

The present invention relates generally to electrically conductive fibers. More specifically, the present invention relates to bicomponent electrically conductive fibers.

BACKGROUND OF THE INVENTION

As used herein, several terms have meanings assigned to them. "Fiber" or "fibers" refer to short length fibers ("staple fibers") and fibers of indefinite length ("filament"). "Multicomponent" refers to that particular fiber structure where two or more distinct materials (e.g., polymers) are present in the fiber cross-section in longitudinally coextensive domains. "Electrically conductive" means having a resistivity not greater than $10^9$ ohms/cm.

Static electricity buildup in carpets and textiles, including those made of synthetic fibers, has long been an inconvenience. With today's widespread use of computers, it has become a more serious problem. For example, static electricity buildup followed by discharge can damage computer circuits and destroy information stored in computer memory. By adding a conductive fiber to carpet yam, the buildup of static electricity is overcome. The problem then becomes producing the conductive fiber.

Two types of conductive filaments are coated filaments and bicomponent filaments, with coated fibers generally having the greater conductivity. There are several approaches to coating filaments to make them conductive, including suffusion coating. Suffusion coating involves making a fiber electrically conductive by suffusing conductive material into the periphery of the fiber. Suffusion coating is described in U.S. Pat. Nos. 3,823,035 and 4,255,487, both to Sanders, and U.S. Pat. No. 4,704,311 to Pickering et al. U.S. Pat. No. 5,308,563 to Hodan et al. describes a process for producing a supported co-spun yam by separating one or more filaments from co-spun yam, suffusing carbon into the periphery of the separated filament and recombining the filaments. Hodan states that the process can accommodate multicomponent fibers.

Although highly electrically conductive, conventional suffusion coated fibers may have several shortcomings. For example, in some cases, the suffusion coating process can damage the physical properties of the resulting fiber. Suffusion coated fibers are difficult to hide due to their dark color and can be stiff, brittle and abrasive.

Another method of coating filaments to make them conductive involves softening a lower melting polymer that is present on the periphery of the fiber and adhering conductive particles to the lower melting polymer in the softened state. UK Patent Specification No. 1 396 072 describes adhering metal particles to a fiber having, for example, a nylon 6 core and a copolyamide of nylon 6 and nylon 6/12 as the sheath. Other examples of bicomponent fibers with lower softening polymers present at the periphery to facilitate adherence of conductive particle are: UK Patent Specifications No. 1 391 262 and 1,468,010; U.S. Pat. Nos. 3,958,066 to Imamura et al.; 4,061,827 to Gould; 4,242,382 to Ellis et al.; and 4,388,370 to Ellis et al.

Electrically conductive fibers can be made also by direct spinning of polymer containing conductive material with polymer not containing such material. The conductive and non-conductive materials may be arranged in a variety of preselected arrangements. Such co-spinning is described in U.S. Pat. Nos. 3,803,453 to Hull; 4,129,677 to Boe; 4,185,137 to Kinkel; 4,207,376 to Nagayasu et al.; 4,216,264 to Naruse et al. and 4,420,534 to Matsui et al.

Coated fibers are generally quite conductive but the properties of the fibers may be less than desirable for certain applications because the polymers used to make the fibers must be able to accept the conductive material by softening at a reasonable temperature. Suffusion coated fibers do not necessarily suffer from this drawback because almost any polymer will be soluble under some conditions and, thus, able to accept the suffusion coating. However, the solvents that must be used for some polymers are so harsh or environmentally unfriendly that the suffusion coating process is not practical without numerous safeguards. Even with the numerous safeguards in place, there is still a risk of severe human injury or environmental contamination.

Although as noted, they are highly conductive, coated conductive fibers have several other performance disadvantages due to the presence of the conductive material at the surface of the fiber, such as in a sheath/core type fiber. Some of these disadvantages are a very black color (if carbon is the conductive material) and high abrasivity from the conductive particles at the fiber surface.

Methods for coating fibers to make them conductive usually result in the entire periphery of the fiber having the conductive material lodged thereon or therein. There is a need for a practical method to target the conductive particles to a portion of, but not all of, the periphery of the fiber.

SUMMARY OF THE INVENTION

The present invention addresses the shortcomings in the art with a method for preparing electrically conductive fiber from filamentary polymeric substrate by supplying a multicomponent filament having a suffusible component present at some or all of the periphery of the filament to a suffusion coating apparatus. The suffusible component is soluble in a suffusion coating solution. The filament also has an impervious component that is substantially impervious to the suffusion coating solution. Then, finely-divided, electrically conductive particles are suffused into a surface of the suffusible component in an amount sufficient to render an electrical resistance in the filament of not more than about $10^9$ ohms/cm without significantly suffusing the finely-divided, electrically conductive particles into the impervious component.

Another aspect of the present invention is a multicomponent fiber. The fiber has a suffusible component present at some or all of the periphery of the fiber and an impervious component that is longitudinally coextensive with the suffusible component and substantially impervious to solutions which suffuse conductive particles into the suffusible component. Finely-divided, electrically conductive particles are suffused into the suffusible component in an amount sufficient to render an electrical resistance of not more than $10^9$ ohms/cm. The electrically conductive particles are not significantly suffused into the impervious component.

It is an object of this invention to provide a method of preparing electrically conductive fibers in a safe and environmentally responsible manner.

It is another object of the present invention to provide a suffused electrically conductive multicomponent fiber having a enhanced conductivity.

It is a still further object of the present invention to provide a suffused electrically conductive multicomponent filament with low abrasion.

Yet another object of the present invention is to provide a carbon suffused fiber with a gray color.

After reading the following description, related objects and advantages of the present invention will be apparent to those ordinarily skilled in the art to which the invention pertains.

DESCRIPTION OF THE PREFERRED EMBODIMENTS

Figure 1A:
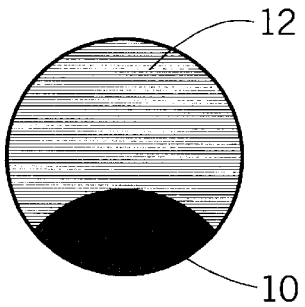
FIGS. 1(*a*) and (*b*) illustrate a first type of exemplary fiber cross-sections according the present invention.

To promote an understanding of the principles of the present invention, descriptions of specific embodiments of the invention follow and specific language describes the same. It will nevertheless be understood that no limitation of the scope of the invention is thereby intended, and that alterations, modifications and further applications of the principles of the invention discussed are contemplated as would normally occur to one ordinarily skilled in the art to which the invention pertains.

One embodiment of the present invention is a method for preparing electrically conductive fiber from a filamentary polymeric substrate. The method and the fiber produced thereby (which is also part of this invention) permit selective targeting of a suffused portion of a fiber.

In general, the method involves supplying a multicomponent filament to a suffusion coating apparatus. The multicomponent filament has a suffusible component present at some or all of the periphery of the filament. The suffusible component is dissolved by a suffusion coating solution. The filament also has an impervious component that is substantially impervious to the suffusion coating solution. Finely divided conductive particles are suffused into the suffusible component without significantly suffusing into the impervious component.

The multicomponent fiber may be produced according to known or to be developed multicomponent spinning techniques. One suitable method is disclosed in U.S. Pat. No. 5,162,074 to Hills, which is incorporated herein by reference. In a typical exemplary process, spun molten filaments are quenched by air blowing in cooling cabinets. A liquid finish may then be applied to the fibers to aid in processing.

Further processing usually takes one of three routes (but this should not be considered limiting). First, monocomponent fibers can be wound as undrawn yam at a speed of about 500 to about 1500 meters per minutes. This yam is drawn in a separate step to a draw ratio of about 2.5 to about 4.5. The drawing step can be performed on a draw-winder or draw-texturing machine. The final drawn denier of the monofilament ranges from about 3 to about 30 denier and even 1 mm or larger.

Second, monofilament fibers can be spun-drawn in a single step across multiple godets. The initial godet(s) would have a speed of about 300 to about 1200 meters per minute and the final godet(s) about 750 to about 5500 meters per minute. The final denier of the monofilament ranges from about 3 to about 30 denier or even 1 mm or larger.

Third, fully drawn monofilaments can be produced in a single step using a high speed spinning process. The fibers are spun at about 4000 to about 6000 meters per minute to a final denier in the range from about 3 to about 30.

The largest monofilaments might be spun using the first or second methods. They may require low production speeds and water quenching; however, these larger fibers can typically be used in brushes, belts or heavy woven fabrics such as carpet backings.

The suffusion coating process may be an integral part of the fiber manufacturing process or it may be a separate step. Suffusion coating may take place during fiber making processes commonly referred to as "one-step" or "two step" processes as described in U.S. Pat. No. 5,308,563 to Hodan which is incorporated herein by reference for the exemplary fiber making techniques taught therein. Also, the fiber may be suffusion coated in a separate process. Exemplary processes are spin-draw-coat; spin then coat; and spin-draw then coat. Suffusion coating may take place by orifice coating, grooved roller, or static applicator.

Suffusion coating steps useful in the process of the present invention are described in U.S. Pat. Nos. 3,823,035 and 4,255,487, both to Sanders; and U.S. Pat. No. 4,704,311 to Pickering et al., all three of which are incorporated by reference for the suffusion coating technique taught therein. As an example of a suffusion coating step, the supply yam package is positioned upstream of a series of ceramic guides. The guides direct the yam to a coating applicator. The applicator may be either an orifice through which the yam passes or a rotating grooved roller. As will be apparent to those skilled in the art, the choice of applicators depends primarily on the denier, the physical properties of the supply yam and its intended end use. The coated yam then may pass through a dryer tube supplied with hot air blown counter to the direction of the yam. The yam is preferably dry upon exiting the tube. Preferably, drying will be timed to remove the suffusion coating solvent after a desired degree of penetration into the suffusible component has taken place.

After exiting the dryer tube, the yam makes several wraps around a godet and idler roll. The godet may be from about 500 to about 1000 meters per minute. The godet pulls the yam through the coating applicator and drying tube. The yam is then wound on a bobbin. When the suffusible component is nylon 6, one exemplary suffusion coating mix contains about 4% by weight conductive carbon black, about 2% by weight nylon 6, about 21% by weight formic acid and about 73% by weight acetic acid. The preferred suffusion coating solvent is one that does not dissolve or react with the electrically conductive particles.

The impervious component may be any fiber-forming component that is substantially impervious to the suffusion coating solution selected to suffusion coat the suffusible component. It should be readily understood that nearly every material is pervious to some solvent. As used in this specification, "impervious" is a relative term used to describe that the impervious component is not significantly affected by the solution chosen to suffuse conductive material into the suffusible component. The appropriate impervious component will be selected on its physical or chemical characteristics based on the intended end use of the fiber. The preferable impervious material will be in most cases a melt-spinnable thermoplastic polymer that has characteristics desirable for the particular end use. Melt spinnable polymers are currently preferred because of the melt-spinning techniques currently available for preparing multicomponent fibers. This should not be considered limiting because other methods may become available that will facilitate other types of multicomponent fiber forming techniques. For certain end uses, fibers with high heat resistance or gamma radiation resistance, etc., are necessary and impervious materials should be selected to satisfy these requirements. Some suitable impervious materials include poly (ethylene terephthalate); poly(butylene terephthalate); nylon 6/6; polyethylene and polypropylene. Currently, poly (ethylene terephthalate) ("PET") and nylon 6/6 are preferred.

Additionally, the impervious material may contain one or more functional additives according to the desired end properties of the material. For example, flame retardants, delusterants, uv stabilizers, etc., may be added. In one preferred alternate embodiment of the invention, the impervious material is itself made electrically conductive through addition of carbon black or another electrically conductive material including metals such as silver, brass, nickel and aluminum; and metal oxides, such as tin oxide or copper oxide. The presence of conductive material in the impervious material is especially advantageous when the impervious material is a core surrounded or substantially surrounded by the suffusible component.

In addition, more than one impervious component may be used to make a tricomponent (or more) fiber. When more than one impervious component is present, the impervious component may be arranged in a variety of fashions that are not considered limited except by the imagination. The only limitation on the cross-section is that a suffusible component must be present somewhere at the periphery of the fiber in order to accept the suffusion coating.

The suffusible component may be any material that is dissolved under the suffusion coating conditions. Suitable suffusible components include, among others, nylon 6; nylon 6,6; 12; nylon 6,12; and many other polyamides. The suffusible component may contain an unlimited variety of functional additives as known and used in the art.

For some applications, the suffusible component and the impervious component should be selected so that they are chemically compatible to prevent the two components from splitting apart in the end use. Those of ordinary skill in the art will understand the compatibility requirement and will also know how to select compatible polymers or to compatibilize incompatible polymers through compatibilizing agents. The two components can also be selected to provide process efficiencies such as relatively rapid drying time. The components can be selected further to provide properties in the resulting fiber, for example, acid dyeability.

Preferably, the suffusible component will be about 2 to about 98 wt % of the fiber cross-section both before and after suffusion coating. In the case of bicomponent fibers, the preferred weight ratio of suffusible component:impervious component will be from about 2:98 to about 50:50. Currently, the most preferred fiber is round and has a polycaprolactam sheath and a poly(ethylene terephthalate) core. The sheath is about 10 wt % of the fiber.

As discussed, a variety of cross-sectional arrangements are possible. The present invention enables customized electrically conductive fibers in ways not possible before. As with the impervious component, more than one suffusible component can be present At least a portion of one suffusible component must be present at the periphery but another suffusible component could be present at the periphery or not, depending on the desired end result. Of course, it will be recognized that suffusible components which are not in contact with the periphery or the fiber or with another suffusible component will not be affected by the suffusion coating process. The fiber may be round or multilobal. The components may be arranged, for example, side-by-side, as islands-in-a-sea or sheath/core fashion.

The particulate electrically conductive material suffused may be any particulate electrically conductive material and should be selected so that it does not react with the suffusion coating solvent. Exemplary materials include carbon black; metals, such as silver, brass, nickel, aluminum; and metal oxides, such as tin oxide and copper oxide The currently preferred conductive particle is conductive carbon black. The preferred carbon black has a particle size of about 20 to about 40 nm.

Another embodiment of the present invention is an electrically conductive multicomponent fiber having a suffusible component and an impervious component much as described above with respect to the process. Indeed, the process above can be used to make the fiber embodiment of the present invention. The materials useful in the fiber of the present invention are as described above. The fiber of the present invention may have a variety of cross-sections and fibers with certain cross-sections are another embodiment of the present invention. The fibers may be round, triangular, elongated or multilobal. The several components of the fiber may be arranged in an unrestricted variety of cross-sections (e.g., sheath/core, side-by-side, islands-in-a-sea) provided that the suffusible component is at least partly present at the surface of the fiber. Exemplary cross-sections are illustrated in the FIGS. These cross-sections are not intended to be limiting but demonstrate the currently preferred cross-sections of the fiber of the present invention.

The preferred ratio of components is determined by the cross-section, or more precisely, the perimeter of the fiber's cross-section. As the perimeter of the fiber increases (e.g., round versus trilobal), a larger ratio of suffusible component is needed to achieve a target sheath thickness. For example, it is currently preferred that the suffused conductive particles extend inwardly from the perimeter of the fiber a distance equal to about 1/10 the radius of a round filament. For trilobal cross sections, the suffused region preferably extends a distance equal to about 1/10 the radius of the largest circle that may be inscribed within the cross-section.

Figure 1B:
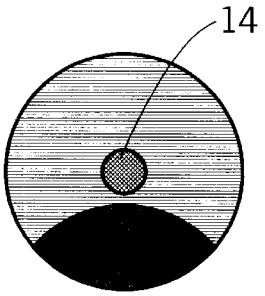

FIG. 1(*a*) illustrates a round fiber cross-section having suffusible component 10. Impervious component 12 forms the majority of the cross-section. Suffusible component 10 is present as a segment of the circle represented by the cross-section.

FIG. 1(*b*) illustrates a round fiber cross-section similar to FIG. 1(*a*) except that conductive core 14 is present.

Figure 2A:
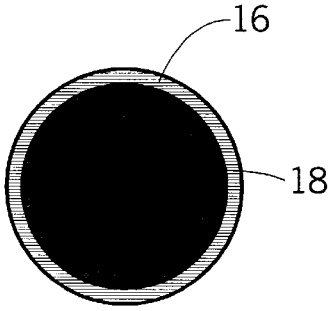
FIGS. 2(*a*) and (*b*) illustrate a second type of exemplary fiber cross-sections according to the present invention.
Figure 2B:
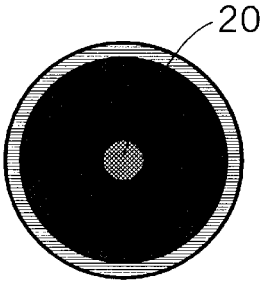

FIG. 2(*a*) illustrates a round fiber cross-section having suffusible component 16 present as a sheath around impervious component 18.

FIG. 2(*b*) illustrates a round fiber cross-section similar to FIG. 2(*a*) except that conductive core 20 is present.

Figure 3A:
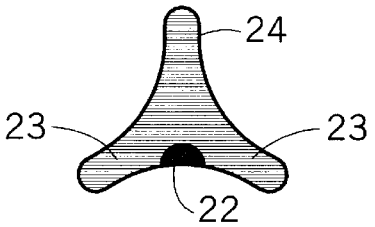
FIGS. 3(*a*) and (*b*) illustrate third exemplary fiber cross-sections according the present invention.
Figure 3B:
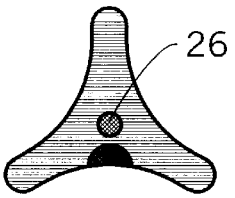

FIG. 3(*a*) illustrates a trilobal fiber cross-section of the present invention. Suffusible component 22 resides in the angle between two lobes 23 of the fiber. The remainder of the fiber is impervious component 24. This cross-section has both low abrasiveness because the suffusible component is protected in the valley between two lobes and hides the color of the conductive components relatively well.

FIG. 3(*b*) illustrates a trilobal fiber having a cross-section similar to FIG. 3(*a*) except for the presence of electrically conductive core 26. This fiber has all of the advantages mentioned for the fiber illustrated in FIG. 3(*a*) but also has the higher conductivity associated with the conductive material in the core.

Electrically conductive cores 14, 20 and 26 may be conductive because they contain carbon-black or some other conductive material. The conductive cores may also be made from inherently conductive polymers. Fibers according to the present invention and with conductive cores are very highly conductive and useful in applications requiring near absolute freedom from static. The fibers can be engineered for use in high temperature environments, special yam physical properties (e.g. shrinkage), etc.

The invention will be described by reference to the following detailed examples. The examples are set forth by way of illustration, and are not intended to limit the scope of the invention.

EXAMPLE 1

Sheath-Core Cross-Section

Sheath/core 45 denier monofilaments are spun on Fourne equipment using BS700E (2.7 RV nylon 6 available from BASF Corporation, Mt. Olive, N.J.) as the sheath and T-741 (poly(ethylene terephthalate) ("PET"), IV=0.64; available from Intercontinental Polymer Inc., Lowland, Tenn.) as the core. The spinning speed is about 700 mpm. Concentric fibers having 20, 25 and 30% by weight nylon 6 sheaths are produced. The undrawn yams are drawn on a drawtwist machine at a draw ratio of 3.95 and a hot pin temperature of 120° C. Occasional sections of PET are undrawn.

The yams are suffusion coated to suffuse carbon black into the nylon 6 sheaths using a roll coater. The physical properties (drawn and undrawn) and resistivities of the yams are measured and presented in the Table. The fibers resemble FIG. 2(*a*).

EXAMPLE 2

Eccentric Cross-Section

The conditions of Example 1 are used except that the fibers have an eccentric cross-section of a nylon 6 core (45% by fiber weight) and the nylon 6 core is exposed to the surface of the fiber. The majority of the fiber's surface is a PET sheath. The coating does not suffuse into the impervious PET as demonstrated by a flaky coating which easily falls off. This coating should be removed prior to use of the fiber. The physical properties of the drawn and undrawn yam are presented in the Table.

Comparative Example

A bobbin of nonconductive, 20 denier, nylon 6 monofilament yam is positioned upstream of a ceramic yam guide. The guides direct the yam to a coating applicator where an amount of suffusion coating material equal to approximately 10% of the fiber weight is applied to the surface of the fiber. The suffusion coating material is about 4% by weight conductive carbon black, about 2% by weight nylon 6, about 21% by weight formic acid and about 73% by weight acetic acid. The yam is then directed through a drying tube where it is contacted by hot air having a temperature of 125°–135° C. blowing in a direction counter to the direction of the yam. The yam exits the drying tube to make several wraps around a drive roll and idler combination. The drive roll has a surface speed of about 600 mpm. The yam is wound onto bobbins.

The physical properties and resistivity are measured and reported in the Table.

TABLE

| Undrawn Yarn Properties | | | | |
|---|---|---|---|---|
| | Concentric (Example 1) | | | Eccentric (Example 2) |
| % Nylon 6 | 20 | 25 | 30 | 45 |
| Denier | 46.6 | 47.1 | 49.2 | 47.4 |
| Elongation | 543 | 502 | 509 | 744 |
| Tenacity | 1.2 | 1.1 | 1.0 | 1.3 |
| **Drawn Yarn Properties** | | | | |
| | Concentric (Example 1) | | | Eccentric (Example 2) |
| % Nylon 6 | 20 | 25 | 30 | 45 |
| Denier | 12.0 | 12.0 | 13.0 | 12.2 |
| Elongation | 50.5 | 46.5 | 43.0 | 35.3 |
| Tenacity | 4.8 | 4.7 | 4.4 | 4.6 |
| **Coated Yarn Properties** | | | | |
| | Concentric (Example 1) | | | Comparative Example |
| % Nylon 6 | 20 | 25 | 30 | |
| Denier | 12.7 | 12.9 | 14.0 | 21.9 |
| Elongation | 52.8 | 47.4 | 46.4 | 26.5 |
| Tenacity | 4.3 | 4.2 | 3.8 | 3.8 |
| Resistivity (ohms/cm) | $4 \times 10^5$ | $9 \times 10^5$ | $3 \times 10^5$ | $2 \times 10^5$ |

What is claimed is:

1. A method of preparing electrically conductive fiber from filamentary polymeric substrate comprising:

(a) supplying to a suffusion coating apparatus, a multicomponent filament having a suffusible component present at some or all of the periphery of the filament, which suffusible component is soluble in a suffusion coating solution and having an impervious component that is substantially impervious to the suffusion coating solution; and (b) suffusing finely-divided, electrically conductive particles into a surface of the suffusible component in an amount sufficient to render an electrical resistance in the filament of not more than about $10^9$ ohms/cm and without significantly suffusing the finely-divided, electrically conductive particles into the impervious component by:

(b1) applying to the filament a dispersion of finely-divided electrically conductive particles in a liquid which is a solvent for the suffusible component but does not dissolve or react with the electrically conductive particles; followed by (b2) removing the solvent from the filament after a desired degree of penetration into the suffusible component has taken place.

2. The method of claim 1 wherein said supplying is as a step in a continuous melt-spinning process.

3. The method of claim 1 wherein said supplying is from a package of wound yarn.

4. The method of claim 1 wherein said supplying is at about 500 to about 1000 meters/minutes.

5. The method of claim 1 wherein the suffusible component is selected from the group consisting of:

nylon 6;

nylon 6,6;

nylon 12;

nylon 6,12; and combinations and copolymers thereof.

6. The method of claim 1 wherein the impervious component is selected from the group consisting of:

poly(ethylene terephthalate);

nylon 6,6;

poly(butylene terephthalate);

polyethylene;

polypropylene;

copolymers thereof; and blends thereof.

7. The method of claim 1 wherein the finely-divided, electrically conductive particles are particles of carbon black.

8. The method of claim 1 wherein the filament has a multilobal cross-section.

9. The method of claim 1 wherein the filament has a cross-section selected from the group consisting of:

sheath/core;

side-by-side; and islands-in-a-sea.

10. The method of claim 1 wherein the filament is a bicomponent filament with a suffusible component to impervious component weight ratio of from about 2:98 to about 50:50.

11. The method of claim 5 wherein the suffusible component is polycaprolactam present at a weight ratio of about 10%.

12. The method of claim 11 wherein the impervious component comprises poly(ethylene terephthalate).

* * * * *